US005163680A

United States Patent [19]

Amron

[11] Patent Number: 5,163,680

[45] Date of Patent: Nov. 17, 1992

[54] BASKETBALL GOAL SIMULATOR

[75] Inventor: Joanna M. Amron, Syosset, N.Y.

[73] Assignee: Talk To Me Products, Inc., Syosset, N.Y.

[21] Appl. No.: 819,060

[22] Filed: Jan. 10, 1992

[51] Int. Cl.[5] ..... A63B 63/08; F41J 5/04

[52] U.S. Cl. ..... 273/1.5 R; 273/320; 273/371; 273/381; 273/402; 273/413

[58] Field of Search ..... 273/1.5 R, 1.5 A, 320, 273/321, 371, 378, 381, 382, 402, 413

[56] References Cited

U.S. PATENT DOCUMENTS 3,907,297 9/1975 Di Leva ..... 273/320
4,013,292 3/1977 Cohen et al. ..... 273/371
4,375,289 3/1983 Schmall et al. ..... 273/371
4,858,920 8/1989 Best ..... 273/1.5 R
4,956,775 9/1990 Klamer et al. ..... 273/1.5 R
5,039,977 8/1991 Mele et al. ..... 273/371

*Primary Examiner*—Benjamin H. Layno
*Attorney, Agent, or Firm*—Gerard F. Dunne

[57] ABSTRACT

A toy for simulating the scoring of goals in the game of basketball includes a rim having an outer surface of conductive material and a frustroconical net suspended from the rim. A ball adapted to fit within the rim has an outer surface of conductive material so that an electric circuit including a signal-generator produces a signal to the player of the game whenever the ball strikes the rim while passing therethrough.

2 Claims, 1 Drawing Sheet

BASKETBALL GOAL SIMULATOR

The present invention relates to a toy for simulating the scoring of a goal in the game of basketball, and more particularly, the game encourages scoring of a goal by shooting a ball through a basketball goal without touching the rim of the basketball goal.

Toys have been developed to simulate the scoring of goals in the game of basketball, and typically such games provide means for registering the passage of a ball through the rim or net of a basketball goal. However, play value can be enhanced by providing a game which provides scoring based upon the ball passing through the rim of the basketball goal without touching the rim to simulate a perfect basketball shot.

According to the present invention, a toy for simulating the scoring of goals to simulate the game of basketball includes a rim having an outer of surface of conductive material and a frustoconical net suspended from the rim. The ball adapted to fit within the rim has an outer surface of conductive material, and electric means are provided to produce a signal to the player of the game whenever the ball strikes the rim when passing therethrough. In this way, a basketball goal that is obtained by the ball passing cleanly through rim without touching the rim can be noted to provide enhanced play value.

Figure 1:
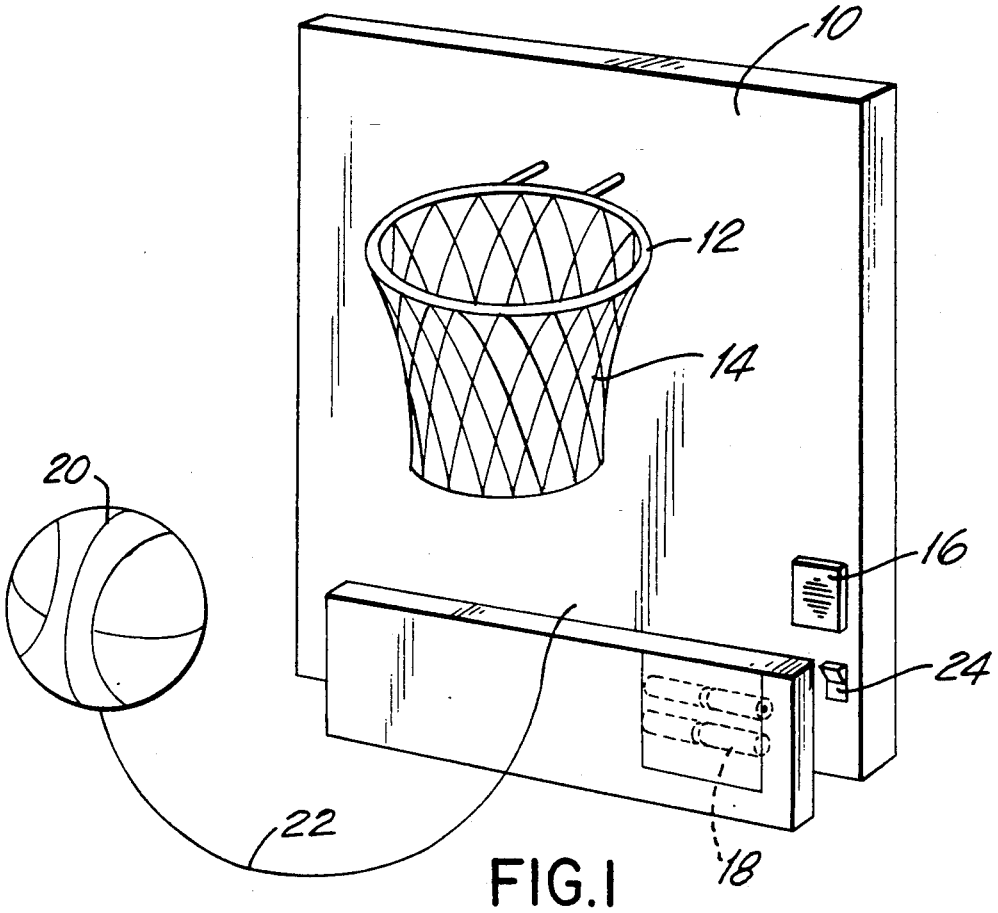
Figure 2:
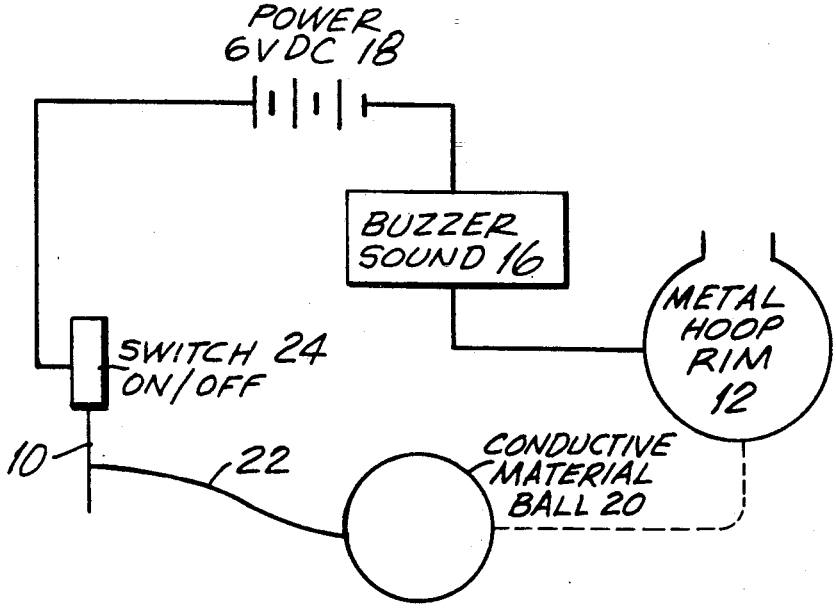

These and other objects, features and advantages of the present invention will become more apparent from the description of a preferred embodiment of the invention made below in conjunction with the following drawings:

FIG. 1 illustrates the toy of the present invention;

FIG. 2 simulates and effective electrical diagram for use with the toy of the present invention.

As illustrated in FIG. 1, a toy according to the present invention has a backboard 10 having a basket of the type generally used for a basketball goal having a rim 12 affixed to the backboard suspended from the rim is a frustoconical net 14 to complete the basketball goal as would well familiar to those skilled in the art.

Located on the front portion of the toy of the present invention is a buzzer element 16, and a battery pack 18 having appropriate electrical connections to activate the buzzer whenever the ball 20 strikes the rim 12 when passing the ball through.

In the illustrative form of the present invention, the rim 12 has an outer surface of conductive material, and the ball 20 also has an outer surface of conductive material. A thin wire 22 is connected to the ball and in series with the battery pack, an on/off switch 24, and the rim 12 to activate the buzzer 16 whenever the ball comes into contact with the rim 12.

In this way, the person playing the game can score points when the ball passes through the rim, but when the ball passes through the rim 12 without contact and no sound emits from the buzzer 16, a higher point value can be attributed for the better shot.

It is understood that the present invention can be embodied in different forms. For example, the buzzer 16 could be another signal-generating device such as a light, and the electrical contact activating the signal source could be made by a capacitance circuit. The conductive ball 20 can thus active the signal-generating device upon contact with the rim 12 by altering the compacitance of the rim 12 by the contact of the ball 12, as opposed to simply providing a series electrical connections.

The present invention is not intended to be limited by the detailed descriptions above, but by the appended claims.

I claim:

1. A toy for simulating the scoring of goals in the game of basketball, including a rim having an outer surface of conductive material and a frustoconical net suspended from said rim, a ball adapted to fit within said rim and having an outer surface of conductive material, electric means for providing a signal to the player of the game when the ball strikes said rim when passing therethrough.

2. A toy according to claim 1, including an electrical circuit connecting in series the rim, the ball, the means providing said signal and a battery pack.

* * * * *